US007479008B2

(12) United States Patent
Thomas

(10) Patent No.: US 7,479,008 B2
(45) Date of Patent: Jan. 20, 2009

(54) BURNER APPARATUS

(76) Inventor: Paul David Thomas, 2370 Champagne Dr., Eagle, ID (US) 83616

( * ) Notice: Subject to any disclaimer, the term of this patent is extended or adjusted under 35 U.S.C. 154(b) by 298 days.

(21) Appl. No.: 11/164,702

(22) Filed: Dec. 1, 2005

(65) Prior Publication Data

US 2007/0128562 A1 Jun. 7, 2007

(51) Int. Cl.
*F23C 6/04* (2006.01)
*F24B 1/18* (2006.01)

(52) U.S. Cl. ..... 431/352; 126/512; 431/125

(58) Field of Classification Search ..... 431/352, 431/125, 12, 72; 126/503, 502, 72, 512
See application file for complete search history.

(56) References Cited

U.S. PATENT DOCUMENTS 2,072,034 A * 2/1937 Geurink et al. ..... 431/42
3,295,585 A * 1/1967 Kovach, Jr. et al. ..... 73/23.31
4,962,750 A * 10/1990 Bridgewater ..... 126/503
5,452,709 A * 9/1995 Mealer ..... 126/512
5,890,485 A * 4/1999 Shimek et al. ..... 126/512
6,192,881 B1 * 2/2001 Nix ..... 126/512
6,289,887 B1 * 9/2001 Oliver et al. ..... 126/92 AC
6,945,774 B2 * 9/2005 Shoeb ..... 431/354

* cited by examiner

*Primary Examiner*—Steven B McAllister
*Assistant Examiner*—Chuka C Ndubizu
(74) *Attorney, Agent, or Firm*—Pradip K. Sahu

(57) ABSTRACT

A burner apparatus for an indoor or outdoor fireplace, fire pit, stove or oven is shown. The burner apparatus operates to produce natural gas fueled or liquid petroleum fueled amber flames among artificial logs, coals or a combination of artificial logs and coals, simulating a natural fire. One embodiment of the burner apparatus comprises a burner tube loop for the distribution of fuel, a fuel/air mixing valve for mixing the fuel and air before ignition of the resulting fuel/air mixture, metal cups for the dissipation of the fuel/air mixture and flames, an ignition system for igniting the fuel/air mixture, a control system for monitoring and controlling the ignition of the fuel and for regulating the flow of fuel, and artificial logs, coals or a combination of logs and coals placed around the burner tube loop to provide for an aesthetically pleasing and natural looking display.

6 Claims, 7 Drawing Sheets

BURNER APPARATUS

BACKGROUND OF THE INVENTION

This invention relates to burners for petroleum or gas burning fireplaces, fire pits, stoves, ovens and similar devices (collectively "Firepits"), and more particularly toward burner apparatuses that provide natural looking amber flames and cleaner emissions.

Firepits fueled by combustible gas or petroleum are common in the industry. These devices have numerous drawbacks. One such drawback is that the flames produced by such devices do not appear natural. That is, the flames have some portion that appears blue due to the burning of the petroleum or natural gas fuel. Natural fires do not have this blue portion of the flame. Enthusiasts of these devices would like to have the devices appear as natural as possible. To that end, developing an apparatus that minimizes the blue portion of the flame such that it is almost nonexistent is very desirable.

Another drawback of the devices currently in the marketplace is that many of them produce harmful emissions. A burner apparatus that provides a cleaner burn with less carbon monoxide emissions and less residue is also very desirable.

OBJECTS OF THE INVENTION

One object of certain embodiments of this invention is to create a natural looking flame. Another object of certain embodiments of this invention is to reduce harmful emissions. Yet another object of certain embodiments of this invention is to provide for nearly simultaneous ignition of each set of flames in embodiments in which more than one flame is desired. Yet another object of certain embodiments of this invention is to provide a control system such that the burner apparatus does not have to be continuously monitored by the user. Yet another object of certain embodiments of this invention is to provide a remote control system such that a user may operate the invention via wireless, handheld devices such as cellular telephones, personal digital assistants or pagers, among other wireless devices.

BRIEF DESCRIPTION OF THE DRAWINGS

The accompanying drawings are a part of this specification. The drawings illustrate optional embodiments of the invention and help to explain certain principles. The drawings are not intended to limit the scope of the invention in any way.

DETAILED DESCRIPTION OF THE INVENTION

Figure 1:
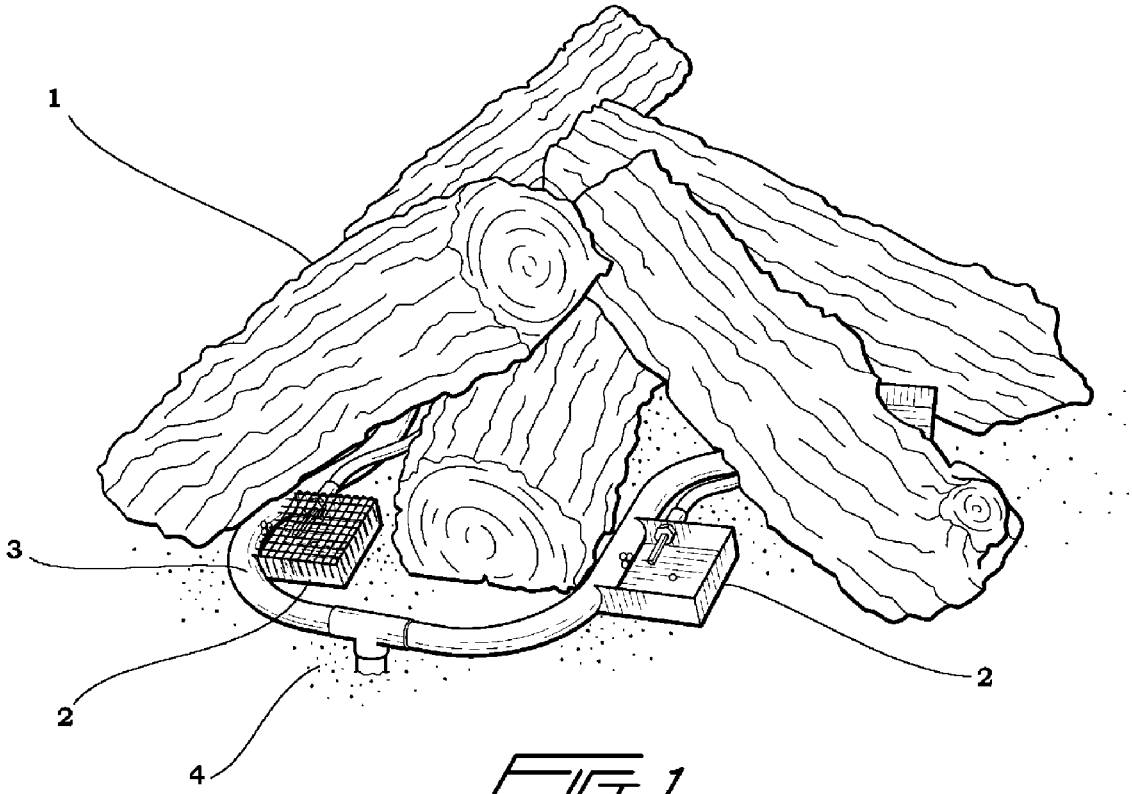
FIG. 1 illustrates a perspective view of one embodiment of the burner apparatus in which one fuel/air dissipation means is covered by a screen and one is left uncovered, and the burner apparatus comprises artificial logs.
Figure 2:
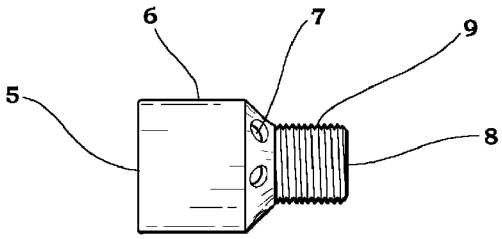
FIG. 2 illustrates a side view of one embodiment of a fuel/air mixing valve.
Figure 4:
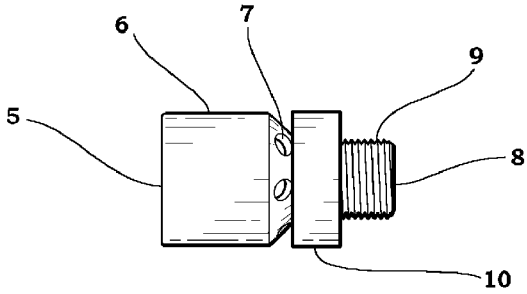
FIG. 4 illustrates a side view of another embodiment of a fuel/air mixing valve in which an external regulator ring is used.
Figure 3:
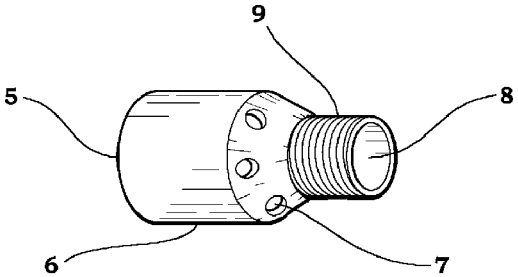
FIG. 3 illustrates a perspective view of the fuel/air mixing valve of FIG. 2.
Figure 5:
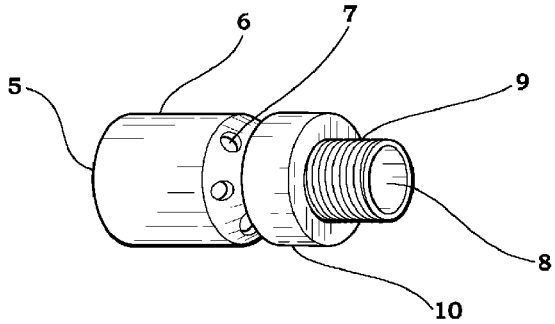
FIG. 5 illustrates a perspective view of the fuel/air mixing valve of FIG. 4.
Figure 6:
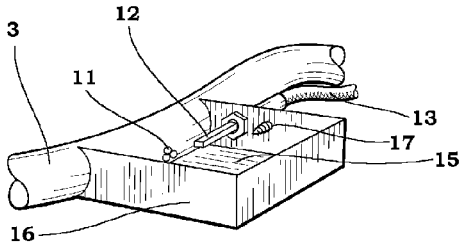
FIG. 6 illustrates a perspective view of one embodiment of a fuel/air dissipation means.
Figure 8:
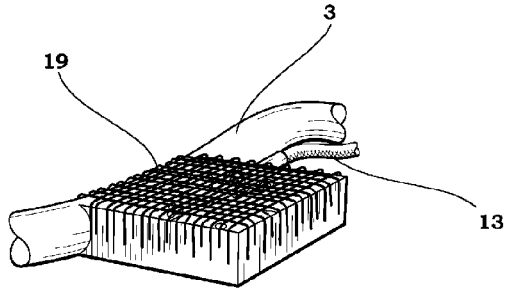
FIG. 8 illustrates a perspective view of one embodiment of a fuel/air dissipation means in which a finer screening means than demonstrated in FIG. 7 is added.
Figure 7:
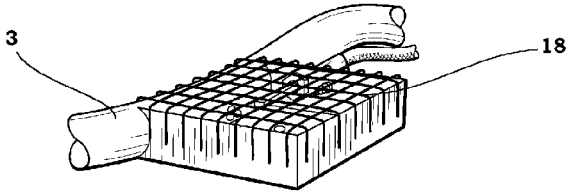
FIG. 7 illustrates a perspective view of one embodiment of a fuel/air dissipation means in which a screening means is added.
Figure 9:
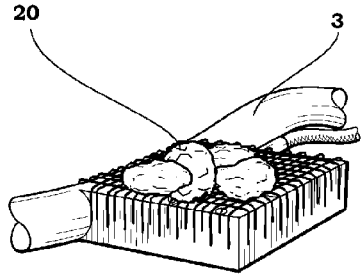
FIG. 9 illustrates a perspective view of one embodiment of a fuel/air dissipation means in which non-combustible volcanic rocks are added.
Figure 10:
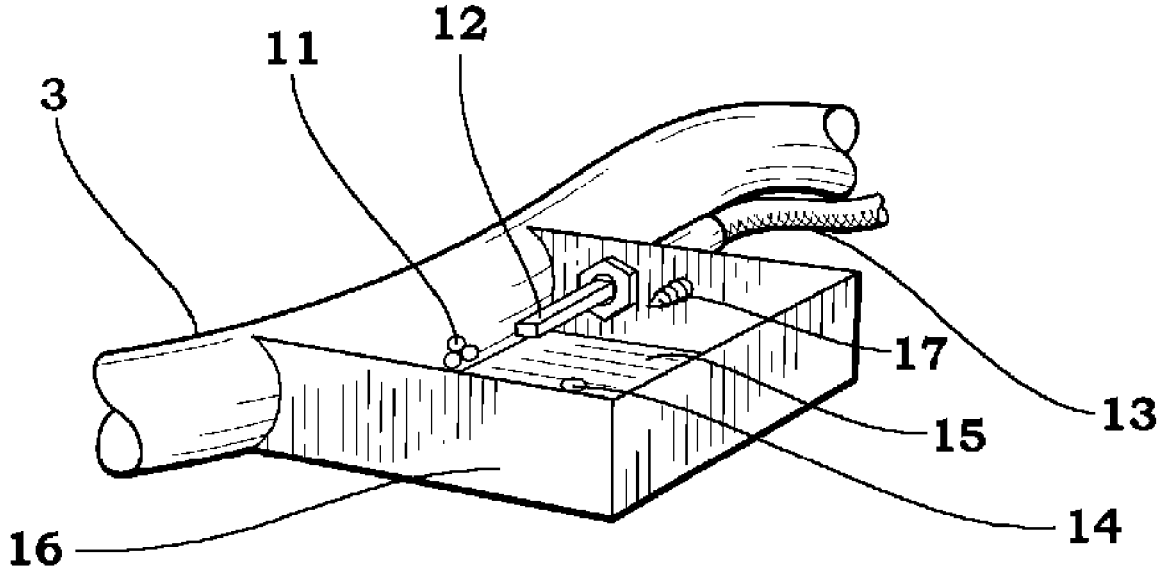
FIG. 10 illustrates a perspective view of one embodiment of a fuel/air dissipation means in which a drain hole is added.
Figure 11:
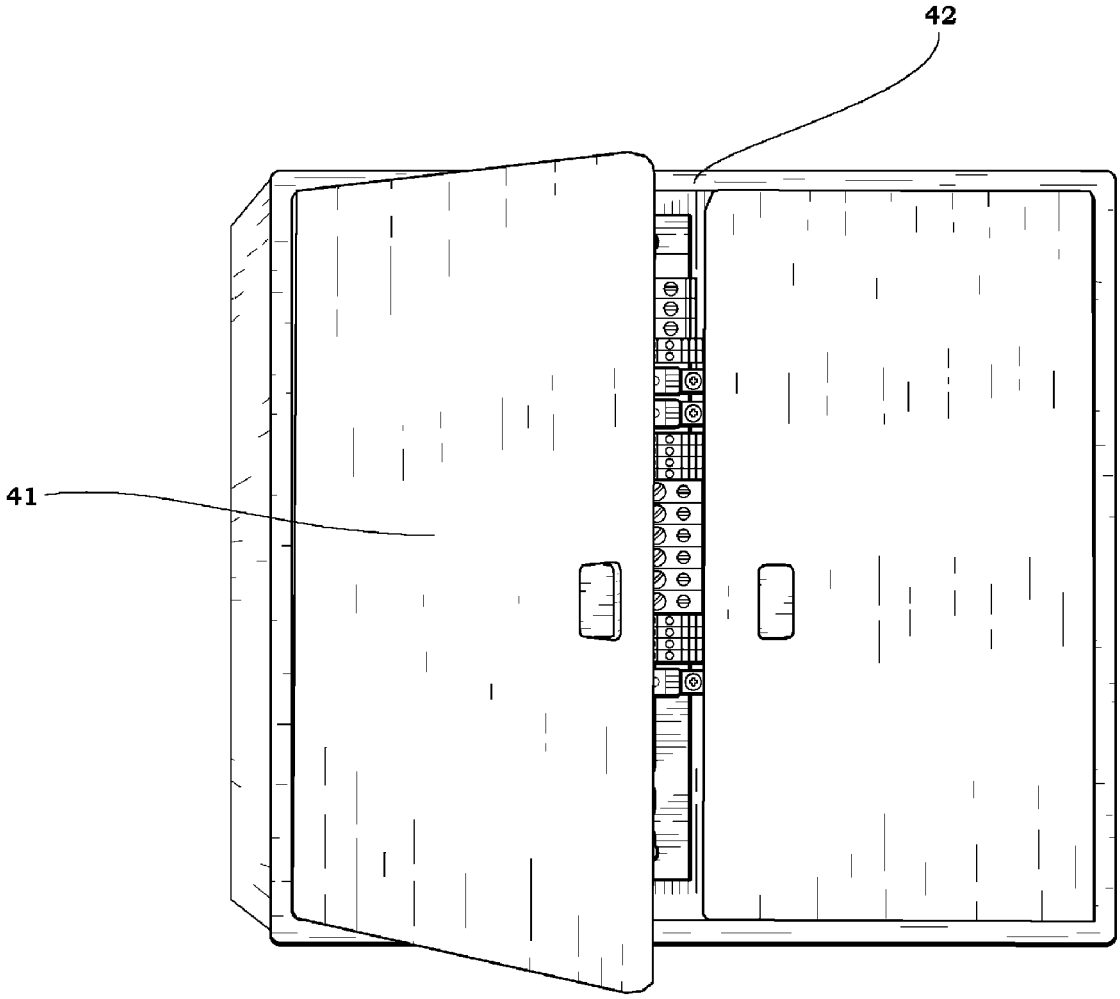
FIG. 11 illustrates a perspective view of one embodiment of a control panel for the burner apparatus, in which one door to the weatherproof enclosure is partially opened and the other door is closed.
Figure 12:
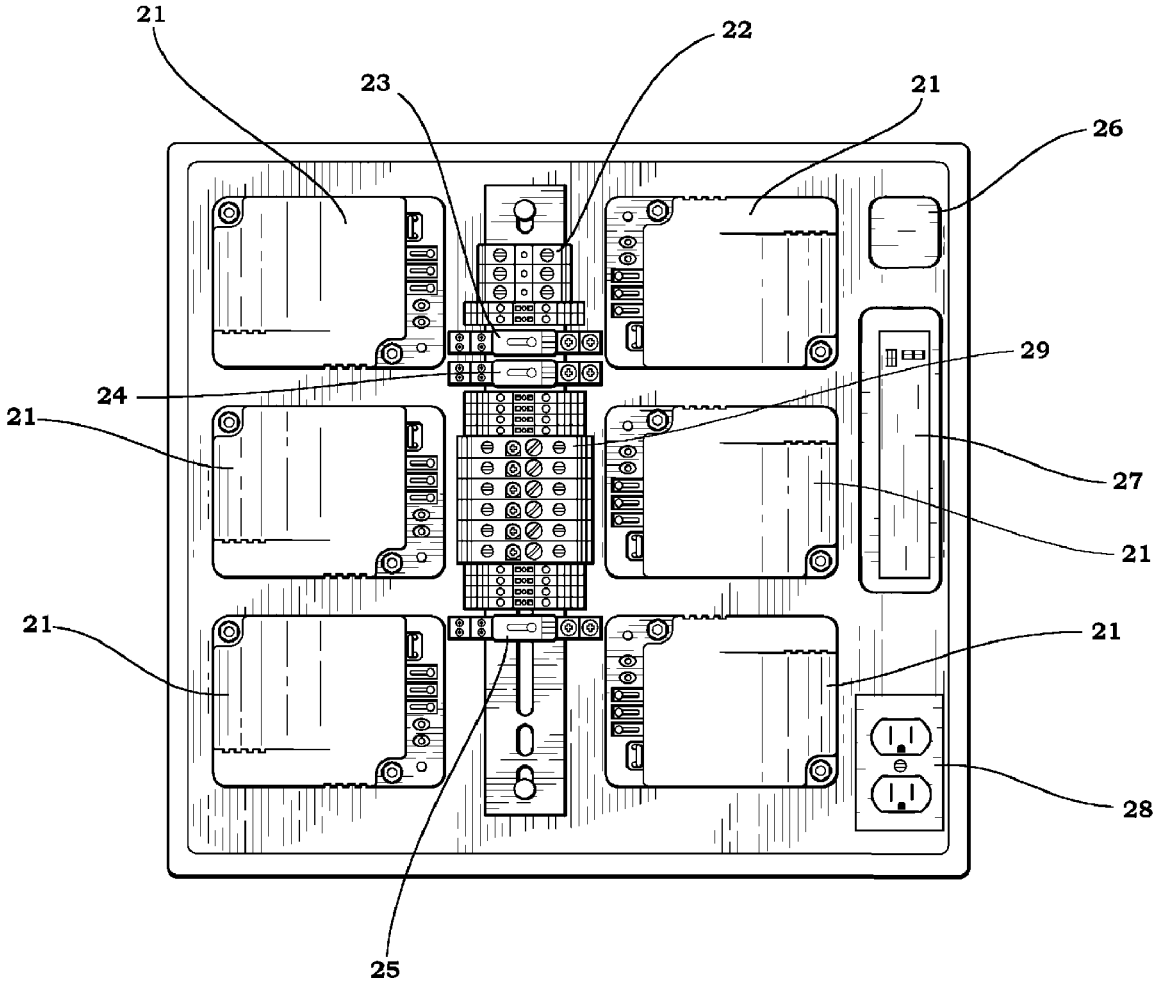
FIG. 12 illustrates a front view of one embodiment of a control panel for the burner apparatus, in which the doors to the weatherproof enclosure are removed to display the contents more effectively.
Figure 13:
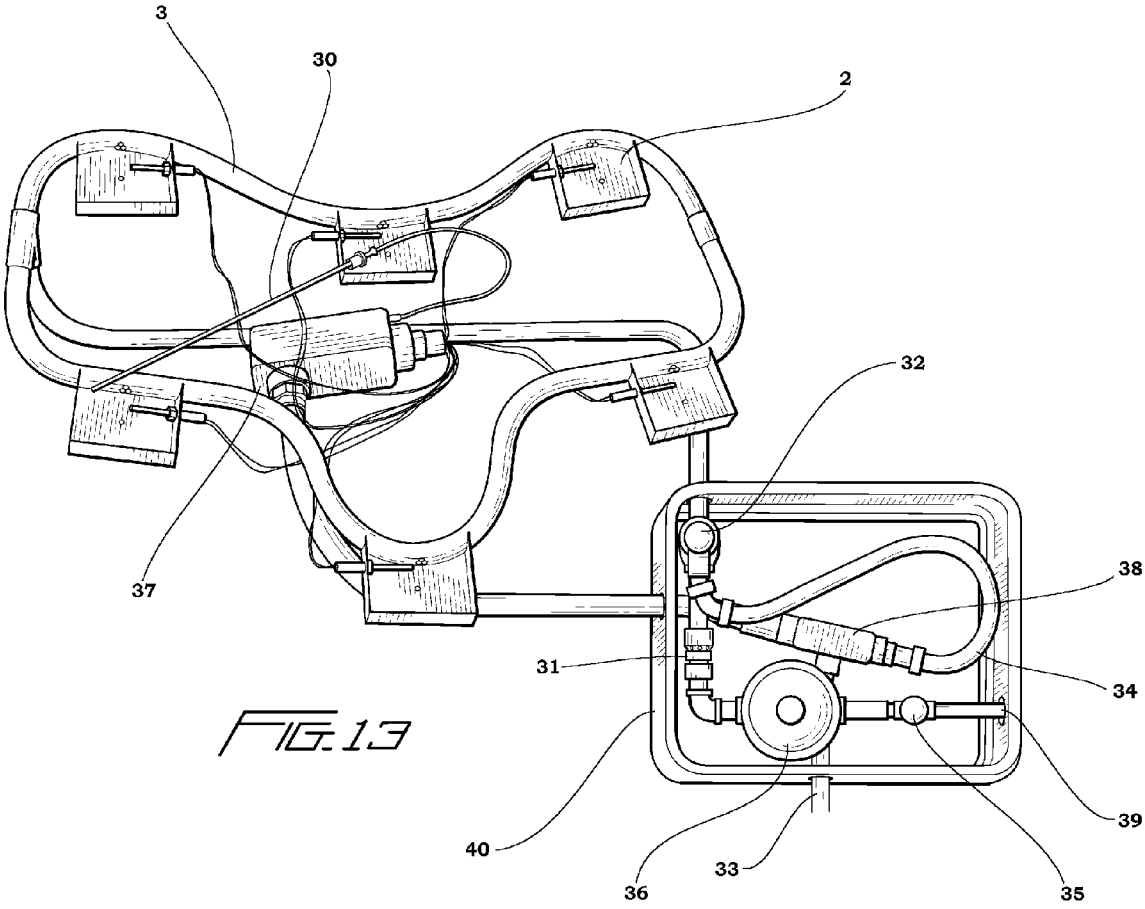
FIG. 13 illustrates a perspective view of one embodiment of the burner apparatus in which a valve box is shown with its cover removed to show the contents more effectively.

Various preferred embodiments are described in the following detailed description. However, the invention is not limited to its preferred embodiments. The invention includes various alternatives, modifications and equivalents within its sprit and scope as are apparent to the skilled artisan.

One embodiment of this invention comprises a burner, a fuel/air mixing valve (31) and an ignition and control system. The burner may comprise at least one burner tube (3), preferably made from copper, adapted to form at least one three hundred sixty degree loop. This loop design provides for pressure equalization of the fuel within the burner tube (3). As such, the pressure and flow of the fuel out of each burner tube (3) is more uniform and results in more consistent flame sizes. Each loop may be generally circular, ovoid or rectangular, among other configurations. The diameter of each burner tube (3) may vary depending on the size of the burner desired. For instance, a three-fourths inch diameter burner tube has been shown to work well with forty-eight inch diameter ovoid burners, whereas a one-half inch diameter burner tube has been shown to work well with thirty-six inch ovoid burners. The number of burner tubes and the sizes and shapes of each loop are determined during a designing phase of the Firepit. One embodiment of the burner apparatus using a single burner tube with a single tube loop is described herein, but apparatuses with multiple burners and multiple tube loops have been shown to work well also. The burner apparatus may be partially buried under the ground (4) in outdoor applications to further enhance the natural looking display.

During the designing phase, the overall design of where non-combustible logs (1), coals or combination of artificial logs and coals are placed in the Firepit is preferably completed first. Next, the overall design is examined to determine the placement of one or more dissipation means (2) that will be used to deflect and dissipate a fuel/air mixture and resulting flames among the artificial logs (1), coals or combination of logs and coals. In the preferred embodiment describe herein, the dissipation means is a metal cup (2), although other dissipation means may be used with this invention. Preferably after the locations of the metal cups (2) are determined, the burner tube (3) is formed to create a loop such that the burner tube (3) can be affixed to each metal cup (2).

The metal cups (2) are preferably made of copper, and their shapes and sizes depend on the overall size of the Firepit. A copper cup that is box shaped, with a three inch by four inch base (15) and one inch vertical side walls (16) has been shown to be effective in most sizes and configurations of Firepits. The metal cups (2) may have at least one drain hole (14) in the base (15) for draining water from the metal cup (2), which may result from rain or melting snow or ice in outdoor Firepit embodiments. The metal cups (2) may be permanently or removably affixed to the burner tube (3). Preferably, the metal cups (2) are permanently riveted and soldered to the burner tube (3). Sand, pebbles, volcanic rocks (20) or similar non-combustible substances may be placed on top of each metal cup (2) to help further dissipate and deflect the fuel and resulting flames. Each metal cup (2) may also be adapted to be covered by a corresponding screening means (18 or 19) for preventing unwanted objects, including the non-combustible substances, from entering into each metal cup (2). A coarse mesh screening means (18) or a finer mesh screening means (19) may be used.

After the burner tube (3) is shaped into a loop, fuel/air exit holes (11) are drilled into the burner tube (3) such that a fuel/air mixture flowing through the burner tube (3) can exit these fuel/air exit holes (11) in a generally downward direction into each metal cup (2). Preferably, three or four fuel/air exit holes (11) should be drilled into the burner tube (3) at each location where a metal cup (2) will be affixed. The size and number of these fuel/air exit holes (11) may vary depending on the desired flame sizes. The angle that these fuel/air exit holes (11) are drilled into the burner tube (3) is preferably sixty degrees below horizontal on the bottom portion of the burner tube (3). The resulting downward flow of the fuel/air mixture helps to create more natural looking flames.

In one embodiment, a fuel/air mixing valve (31) is placed between the fuel source and the burner tube (3) to allow mixing of air and fuel before entering the burner tube (3). The mixing of fuel and air before entering into the burner tube (3) helps to decrease the amount of the blue portion of the flames and helps to reduce harmful emissions and residue. The fuel/air mixing valve (31) may be made from a one inch diameter cylindrical brass rod. One embodiment of the fuel/air mixing valve (31) has a threaded portion to form a male connection (9) around a fuel entrance orifice (8) of the fuel/air mixing valve (31) and a threaded portion to form a female connection around a fuel/air exit orifice (5) of the fuel/air mixing valve (31).

The fuel enters the fuel/air mixing valve (31) through the fuel entrance orifice (8) and flows into a fuel/air mixing chamber (6). The fuel/air mixing chamber (6) comprises at least one air entrance orifice (7), preferably six air entrance orifices (7), around the circumference of the fuel/air mixing chamber (31). The flow of fuel into and out of the fuel/air mixing valve (31) creates a vacuum effect, which draws air into the fuel/air mixing chamber (6) through the air entrance orifices (7). This resulting fuel/air mixture exits the fuel/air mixing valve (31) through the fuel/air exit orifice (5) of the fuel/air mixing valve (31) and into the burner tube (3).

The fuel/air mixing valve (31) may be adapted to receive an external regulator ring (10) on the outer portion of the fuel/air mixing valve (31). This external regulator ring (10) may be moved forward or backward along the longitudinal axis of the fuel/air mixing valve (31) to open and close the air entrance orifices (7) of the fuel/air mixing chamber (6). This can be done to adjust the amount of air that is mixed with the fuel.

In yet another embodiment of this invention, an air injection system may be used to create a fuel/air mixture before the fuel/air mixture enters the burner tube (3). The air injection system may comprise an air compressor; an injection valve with an air entrance orifice, a fuel entrance orifice and a fuel/air exit orifice; a tubal connection between the air compressor and the injection valve; a tubal connection between the injection valve and the fuel source; and a tubal connection between the injection valve and the burner tube (3).

One embodiment of the burner apparatus comprises a valve box (40) that may house components used in regulating the flow of fuel into the burner tube (3). Such components may include, among other components, a pipe that leads to the fuel source (39), a manual gas valve (35), a one half pound fuel regulator (36), an electronic gas valve (32), a flexible conduit (34) that contains electrical connections to the electronic gas valve (32), an electrical junction box (38), and a conduit (33) that connects the electrical junction box (38) to the control panel assembly (42).

In one embodiment of the burner apparatus, the ignition and control system may comprise a weatherproof NEMA (National Electrical Manufacturer's Association) enclosure (41) to house the various modules, controllers, relays and other devices used with the burner apparatus. The ignition and control system may comprise a master on/off switch. The ignition and control system may also comprise silicon carbide igniters (12) mounted in each of the metal cups (2) to ignite the fuel/air mixture as it flows into each metal cup (2). The igniters (12) may be connected to an electrical terminal box (37) via electrical wires (18), and the electrical terminal box (37) may in turn be connected to the control panel assembly (42).

The igniters (12) may be affixed to the metal cups (2) using screws (17). The placement of silicon carbide igniters (12) in each metal cup (2) helps to create simultaneous ignition of the fuel/air mixture throughout the burner apparatus. Kale wool may be used to cover and protect wires leading to the igniters (12) and to protect other materials located in proximity to the burner apparatus from the heat generated by the burner apparatus. The screening means (18 or 19) of each metal cup (2) may also be adapted to prevent the corresponding silicon carbide igniter (12) located in each metal cup (2) from touching the walls (16) or base (15) of the metal cup (2).

The ignition and control system may also have one or more thermocouple probes (30) and corresponding thermocouple modules (26). Each thermocouple module (26) may be adapted to sense and display the temperature of the flames in one or more metal cups (2), and each thermocouple module (26) may be adapted to recognize a range of temperatures to operate within. That is, if the temperature falls outside the range, the thermocouple module (26) may be adapted to shut the electronic gas valve (32), re-initiate the ignition sequence, and/or wait for intervention by a person operating the burner apparatus.

The ignition and control system may also have nitride power modules (21) to provide power to the igniters (12) located in each metal cup (2). The ignition and control system may also comprise a terminal board (22) to connect the various modules, controllers, relays, fuse panels (29), electrical outlets (28) and other devices used with the burner apparatus. The ignition and control system may also have a module for a universal hand held remote control to turn the burner apparatus on or off. The ignition and control system may also have a thermocouple relay (24) as well as an electronic gas valve relay (25) to control when each nitride power module powers up, shuts down and re-powers up in case the corresponding flame is extinguished.

The ignition and control system may also be adapted to have a programmable logic controller (27) and associated relay (23), allowing for operation via various types of electronic devices such as cellular telephones, personal digital assistants and other wireless devices, among others.

What is claimed is:

1. A burner apparatus comprising a) A burner tube means for distributing a fuel/air mixture throughout the burner apparatus i) The burner tube means comprising at least one tube loop ii) The burner tube means further comprising a top tube portion and a bottom tube portion iii) The burner tube means further comprising at least one group of one or more fuel/air exit holes through the bottom tube portion; each group of one or more fuel/air exit holes adapted to allow the fuel/air mixture to flow into a corresponding fuel/air dissipation means iv) The burner tube means not being located within the fuel/air dissipation means b) An ignition and control system means for controlling the flow of fuel into the burner tube means and for controlling ignition of the fuel/air mixture c) The ignition and control system means further comprises silicon carbide igniters positioned in each fuel/air dissipation means d) Each fuel/air dissipation means comprises a metal cup; the metal cup comprising cup wall portions and a cup base portion e) The ignition and control system means further comprises at least one thermocouple probe; each thermocouple probe adapted to sense temperature using a thermocouple module; each thermocouple module adapted to communicate with an electronic gas valve; the thermocouple module further adapted to open and close the electronic gas valve f) Each fuel/air dissipation means further comprises non-combustible materials; each fuel/air dissipation means further comprising at least one corresponding screen, each screen adapted to keep the corresponding silicon carbide igniter from contacting the non-combustible materials; each fuel/air dissipation means further comprising a drain hole in the cup base portion.

2. A burner apparatus comprising a) A burner tube means for distributing a fuel/air mixture throughout the burner apparatus i) The burner tube means comprising at least one tube loop ii) The burner tube means further comprising a top tube portion and a bottom tube portion iii) The burner tube means further comprising at lease one group of one or more fuel/air exit holes through the bottom tube portion; each group of one or more fuel/air exit holes adapted to allow the fuel/air mixture to flow into a corresponding fuel/air dissipation means iv) The burner tube means not being located within the fuel/air dissipation means b) An ignition and control system means for controlling the flow of fuel into the burner tube means and for controlling ignition of the fuel/air mixture c) A fuel/air mixing means for creating the fuel/air mixture before the fuel/air mixture enters the burner tube means d) The ignition and control system means further comprises silicon carbide igniters positioned in each fuel/air dissipation means e) Each fuel/air dissipation means comprises a metal cup; the metal cup comprising cup wall portions and a cup base portion f) The ignition and control system means further comprises at least one thermocouple probe; each thermocouple probe adapted to sense temperature using a thermocouple module; each thermocouple module adapted to communicate with an electronic gas valve; the thermocouple module further adapted to open and close the electronic gas valve g) Each fuel/air dissipation means further comprises non-combustible materials; each fuel/air dissipation means further comprising at least one corresponding screen, each screen adapted to keep the corresponding silicon carbide igniter from contacting the non-combustible materials; each fuel/air dissipation means further comprising a drain hole in the cup base portion h) Each fuel/air dissipation means is attached to the burner tube means i) The burner tube means provides for one of the cup wall portions for each of the metal cups.

3. A burner apparatus comprising a) A burner tube means for distributing a fuel/air mixture throughout the burner apparatus i) The burner tube means comprising at least one tube loop ii) The burner tube means further comprising a top tube portion and a bottom tube portion iii) The burner tube means further comprising at lease one group of one or more fuel/air exit holes through the bottom tube portion; each group of one or more fuel/air exit holes adapted to allow the fuel/air mixture to flow into a corresponding fuel/air dissipation means iv) The burner tube means not being located within the fuel/air dissipation means b) An ignition and control system means for controlling the flow of fuel into the burner tube means and for controlling ignition of the fuel/air mixture c) A fuel/air mixing means for creating the fuel/air mixture before the fuel/air mixture enters the burner tube means d) The ignition and control system means further comprises silicon carbide igniters positioned in each fuel/air dissipation means e) Each fuel/air dissipation means comprises a metal cup; the metal cup comprising cup wall portions and a cup base portion f) The ignition and control system means further comprises at least one thermocouple probe; each thermocouple probe adapted to sense temperature using a thermocouple module; each thermocouple module adapted to communicate with an electronic gas valve; the thermocouple module further adapted to open and close the electronic gas valve g) Each fuel/air dissipation means further comprises non-combustible materials; each fuel/air dissipation means further comprising at least one corresponding screen, each screen adapted to keep the corresponding silicon carbide igniter from contacting the non-combustible materials h) The fuel/air mixing means further comprises an air injection means. The air injection means further comprising an air compressor, an injection valve with an air entrance orifice, a fuel entrance orifice and a fuel/air exit orifice; a tubal connection between the air compressor and the injection valve; a tubal connection between the injection valve and the fuel source; and a tubal connection between the injection valve and the burner tube.

4. A burner apparatus comprising a) A burner tube, i) The burner tube adapted to form a three hundred sixty degree loop ii) The burner tube further comprising a top tube portion and a bottom tube portion iii) The burner tube further comprising at least one fuel/air exit hole through the bottom tube portion, each fuel/air exit hole adapted to allow the fuel/air mixture to exit the burner tube in a generally downward direction into a corresponding metal cup (1) Each corresponding metal cup affixed to the burner tube such that the fuel/air mixture flowing from the corresponding fuel/air exit holes will be forced into the corresponding metal cup (a) Each metal cup comprising a cup base and cup walls (b) Each metal cup adapted to be covered by a corresponding screening means for preventing objects from entering each metal cup; each screening means adapted to allow the fuel/air mixture to enter each metal cup (c) An ignition and control system comprising (i) At least one gas igniter mounted in a corresponding metal cup (ii) A nitride power module corresponding to each igniter (iii) A time delay relay corresponding to each igniter (iv) A thermocouple probe and a corresponding thermocouple module adapted to sense the temperature of flames in each metal cup (v) A universal hand held remote (vi) A programmable logic controller for controlling ignition of the fuel via remote control (vii) An enclosure means for protecting portions of the ignition and control system from varying weather conditions.

5. The burner apparatus of claim 4 further comprising a) A fuel/air mixing chamber, the fuel/air mixing chamber further comprising i) A fuel receiving portion, a fuel entrance orifice, a fuel/air mixing chamber, at least one air entrance orifice, a fuel/air mixture exit orifice, a burner tube receiving portion, a longitudinal axis and an outer body portion ii) The fuel/air mixing chamber adapted to allow air entering through each air entrance orifice and fuel entering through the fuel entrance orifice to combine to form a fuel/air mixture (1) The outer body portion adapted to receive an air regulating ring (2) The air regulating ring adapted to move along the longitudinal axis such that the air regulating ring may open, partially close or close each air entrance orifice.

6. The burner apparatus of claim 4 further comprising a) An air injection system, the air injection system further comprising i) An air source ii) An air compressor iii) An injector valve with an air entrance orifice, a fuel entrance orifice and a fuel/air exit orifice;

iv) A tubal connection between the air compressor and the injector valve; a tubal connection between the injector valve and the fuel source; and a tubal connection between the injector valve and the burner tube.

* * * * *